US008322821B2

(12) United States Patent
Tsai et al.

(10) Patent No.: US 8,322,821 B2
(45) Date of Patent: Dec. 4, 2012

(54) SYSTEM AND METHOD FOR FACILITATING REPLACEMENT OF A PRINTHEAD WITH MINIMAL IMPACT ON PRINTHEAD ALIGNMENT

(75) Inventors: Jason Victor Tsai, Lake Oswego, OR (US); Jamie Kelso, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 564 days.

(21) Appl. No.: 12/415,961

(22) Filed: Mar. 31, 2009

(65) Prior Publication Data

US 2010/0245415 A1 Sep. 30, 2010

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS 6,213,580 B1 * 4/2001 Segerstrom et al. ..... 347/19
6,244,686 B1 * 6/2001 Jensen et al. ..... 347/37
6,561,613 B2 5/2003 Cunnagin et al.
6,688,721 B1 2/2004 Serra
6,773,086 B2 8/2004 Serra et al.
6,937,260 B2 8/2005 Williams et al.
7,052,110 B2 * 5/2006 Jones et al. ..... 347/37
7,204,571 B2 4/2007 Platt et al.
7,222,934 B2 5/2007 Williams
7,309,118 B2 12/2007 Mizes et al.
7,419,230 B2 9/2008 Tatsuta et al.

* cited by examiner

*Primary Examiner* — Ryan Lepisto
*Assistant Examiner* — Erin Chiem
(74) *Attorney, Agent, or Firm* — Maginot, Moore & Beck, LLP

(57) ABSTRACT

A system enables a printhead to be aligned independently of other printheads in a printhead assembly. The system includes a printhead configured to eject ink onto an image receiving member, a plate to which the printhead can be rigidly mounted and selectively removed, and a translation carriage to which the plate is rigidly mounted and locked into position with reference to a distance between the plate and the image receiving member, a pitch position, and a yaw position, the translation carriage being coupled to an actuator for movement of the translation carriage, plate, and printhead in a cross-process direction across the image receiving member.

5 Claims, 5 Drawing Sheets

SYSTEM AND METHOD FOR FACILITATING REPLACEMENT OF A PRINTHEAD WITH MINIMAL IMPACT ON PRINTHEAD ALIGNMENT

TECHNICAL FIELD

This disclosure relates generally to imaging devices having multiple printhead assemblies, and more particularly, to the alignment of printheads in such imaging devices.

BACKGROUND

Some ink printing devices use a single printhead, but many use a plurality of printheads to increase the rate of printing. For example, four printheads may be arranged in two rows with each row having two printheads. The two printheads in the first row are separated by a distance corresponding to the width of a printhead. The first printhead in the second row is positioned at a location corresponding to the gap between the two printheads in the first row and the last printhead in the second row is separated from the first printhead in the second row by a distance corresponding to the width of a printhead. This arrangement is called a staggered full width array (SFWA) printhead assembly and an embodiment of a SFWA assembly is shown in FIG. 1.

Synchronizing the passage of an image receiving member with the firing of the inkjets in the printheads enables a continuous ink image to be formed across the member in the direction perpendicular to the direction of member passage. Alignment of the ink drops ejected by the printheads, however, may not be as expected. Each printhead in the printhead assembly has six degrees of positional freedom, three of which are translational and three of which are rotational. The printheads need to be precisely aligned to provide a smooth transition from the ink drops ejected by one printhead to the ink drops printed by the other printheads in the assembly. Misalignment of printheads may occur from, for example, printheads failing to meet manufacturing tolerances, thermal expansion of the printhead and associated parts of the printer, vibration of the printhead, or the like.

Misalignments between printheads in three of the six degrees of freedom may be categorized as roll or stitch errors. Roll errors can occur when a printhead rotates about an axis normal to the imaging member. Roll error causes a skew in the rows of ink drops ejected by the printhead relative to the imaging member. This skew may be noticeable at the interface between two printheads and may cause an objectionable streak. Stitch errors occur from shifts in one printhead compared to another printhead. Y-axis stitch errors arise from shifts that cause ink drop rows from the shifted printhead to land above or below the ink drop rows ejected by preceding or following printhead. X-axis stitch errors arise from shifts that cause the first and last drops in the rows printed by the shifted printhead to be too close or too far from the last and first drops, respectively, in the rows printed by the preceding and following printheads, respectively. Of course, if the shifted printhead is the first or last printhead in the assembly, shifting of the first drop or the last drop in the rows, respectively, does not occur at an intersection with another printhead. Thus, aligning printheads in a printhead assembly with sufficient accuracy to allow high image quality is desired.

One previously known printhead assembly included printheads that were attached to a mounting of a translation carriage. The printheads have flanges extending from them that are acted on by cams to move the printhead for alignment. This type of alignment system requires the printheads to be formed with extensions. Additionally, one printhead in the assembly was deemed the reference printhead and alignment of the other printheads was conducted with reference to the ink drops ejected by the reference printhead. Moreover, if a printhead was replaced in a printhead assembly, the printhead required alignment as manufacturing tolerances for the printhead extensions may position the printhead on the translation carriage differently than the extensions on the replaced printhead. Because printheads may be replaced during service calls once a printer is put into operation, easier and faster printhead replacement with minimal impact on printhead alignment is desirable.

SUMMARY

A system enables a printhead to be replaced easily and aligned independently of other printheads in a printhead assembly. The system includes a printhead configured to eject ink onto an image receiving member, a plate to which the printhead can be rigidly mounted and selectively removed, and a translation carriage to which the plate is rigidly mounted and locked into position with reference to a distance between the plate and the image receiving member (Z position), a pitch position, and a yaw position, the translation carriage being coupled to an actuator for movement of the translation carriage, plate, and printhead in a cross-process direction across the image receiving member.

The system may be implemented in a printer to enable replacement of printheads in the printer without disrupting the Z position, pitch position, and yaw position of the plate. The printer includes an image receiving member, two printheads configured to eject ink onto the image receiving member, two plates, each plate having one printhead rigidly mounted to the plate, and a translation carriage to which the two plates are rigidly mounted and each plate being locked into position with reference to a distance between the plate and the image receiving member (Z position), a pitch position, and a yaw position, the translation carriage being coupled to an actuator for movement of the translation carriage, plate, and printhead in a cross-process direction across the image receiving member and the plates being configured to enable the printheads to be removed from the plates without disturbing the Z position, pitch position, and yaw position of the plates.

A method enables a printhead to be replaced and aligned independently of other printheads in a printhead assembly. The method includes rigidly mounting a plate to a translation carriage that is coupled to an actuator for movement of the translation carriage and plate in a cross-process direction across an image receiving member in a printer, fixing a distance between the plate and the imaging member, a yaw orientation of the plate, and a pitch orientation of the plate, rigidly mounting a printhead to the plate, and controlling at least one actuator coupled to at least one movable member that engages the plate to adjust one of a X stitch position and a roll angle of the plate with reference to the image receiving member.

BRIEF DESCRIPTION OF THE DRAWINGS

The foregoing aspects and other features of a system that facilitates printhead replacement with minimal impact on printhead alignment and enables independent alignment of the printhead in at least two degrees of freedom of movement are explained in the following description, taken in connection with the accompanying drawings.

DETAILED DESCRIPTION

Figure 1:
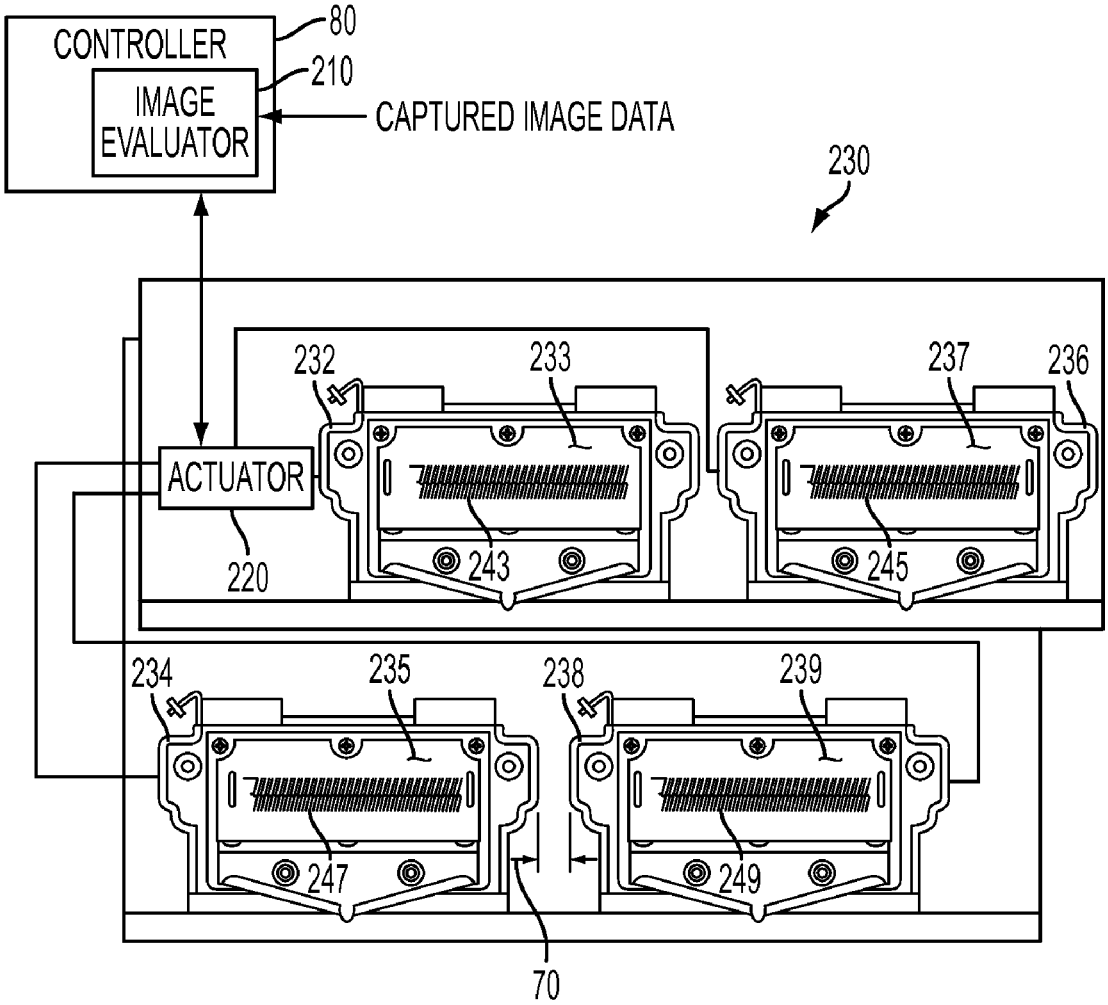
FIG. 1 is a perspective view of a printhead assembly having four printheads.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. Also, the description presented below is directed to a system that enables positional correction for a printhead in two degrees of freedom of movement that is independent of any adjustments made to any other printhead in a printhead assembly.

Figure 8:
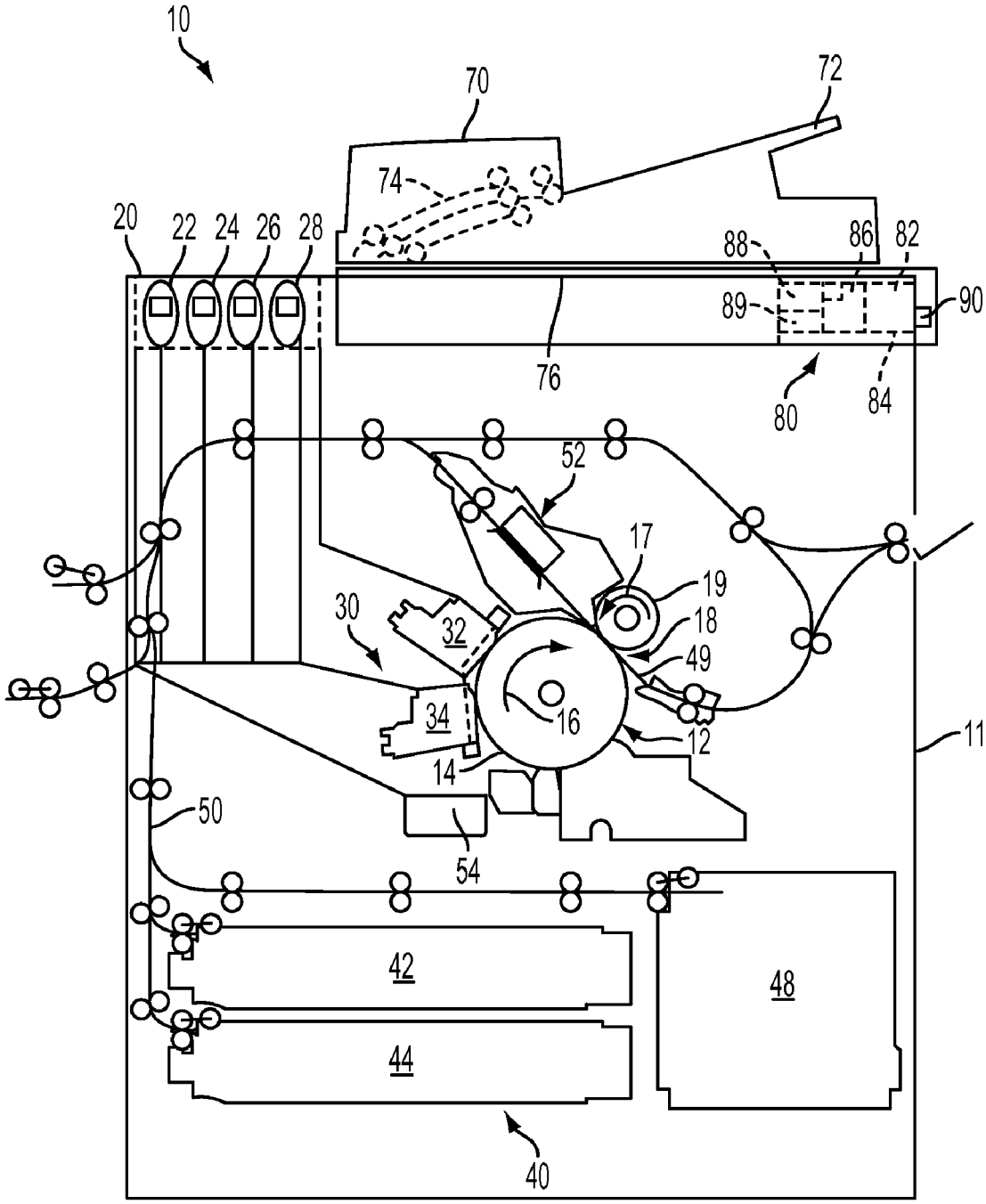
FIG. 8 is a schematic view of a printer in which the carrier plate of FIG. 4 may be mounted to the translation carriage.

Referring now to FIG. 8, an embodiment of an image producing machine, such as a high-speed phase change ink image producing machine or printer 10, is depicted. As illustrated, the machine 10 includes a frame 11 to which are mounted directly or indirectly all its operating subsystems and components, as described below. To start, the high-speed phase change ink image producing machine or printer 10 includes an image receiving member 12 that is shown in the form of a drum, but can equally be in the form of a supported endless belt. The image receiving member 12 has an imaging surface 14 that is movable in the direction 16, and on which phase change ink images are formed. A transfix roller 19 rotatable in the direction 17 is loaded against the surface 14 of image receiving member 12 to form a transfix nip 18, within which ink images formed on the surface 14 are transfixed onto a heated media sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g., two (2)) of separate printhead assemblies 32 and 34 as shown.

As further shown, the phase change ink image producing machine or printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multi-tasking processor for operating and controlling all of the other machine subsystems and functions, including the printhead cleaning apparatus and method discussed below.

The controller 80 may be implemented with general or specialized programmable processors that execute programmed instructions. The instructions and data required to perform the programmed functions may be stored in memory associated with the processors or controllers. The processors, their memories, and interface circuitry configure the controllers to perform the processes that enable the generation and analysis of printed test strips for the generation of firing signal waveform adjustments and digital image adjustments. The processes implemented by one or more controllers also enable actuators to be controlled selectively to align one or more of the printheads. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 48 and handled by substrate system 50 in timed registration with image formation on the surface 14. Finally, the image is transferred from the surface 14 and fixedly fused to the image substrate within the transfix nip 18.

To evaluate the position and alignment of the printheads in a printhead assembly, the controller 80 may execute programmed instructions that enable the printer to implement a plurality of processes for generating positional correction data to address the roll and/or stitch errors, and evaluate the application of the correction data and the need to continue further error processing. In general, these processes receive captured image data of a test pattern printed on an image receiving member. The controller may implement an image evaluator that processes captured image data and enables the controller to generate positional correction data for alignment of the printheads. In order to enable one printhead in the printhead assembly to be adjusted in more than one degree of freedom without reference to alignment of another printhead in the assembly, a carrier plate has been developed that enables simplification of the printhead configuration and facilitates selective replacement of a printhead in the assembly. An implementation of the carrier plate and its use in an alignment method is discussed below.

Referring now to FIG. 1, a printhead assembly for a high-speed, or high throughput, multicolor image producing machine is shown. The assembly 230 is coupled to the controller 80 and at least one actuator 220. The assembly 230 has four printheads 232, 234, 236, and 238. The upper printheads 232 and 236 and lower printheads 234 and 238 are arranged in a staggered pattern. Each printhead 232, 234, 236, and 238 has a corresponding front face 233, 235, 237 and 239 for ejecting ink onto an image receiving member to form an image. The staggered arrangement enables the printheads to form an image across the full width of the substrate. In print mode the printhead front faces 233, 235, 237, 239 are disposed close, for example, about 23 mils, to the imaging surface 14 of the drum 12. In one embodiment, each printhead is approximately 2.5 inches long. This length enables the printhead assembly to print an image that is approximately 10 inches long in the cross-process direction.

As described in more detail below, each printhead is rigidly mounted to a carrier plate that is rigidly mounted to a translation carriage. The carrier plate is coupled to an actuator 220 for selective movement of the carrier plate and the printhead carried by the plate. The actuator is coupled to the carrier plate through gear trains, translational, or rotational linkages to move the plates and the printheads mounted to them. The actuator 220 responds to signals from the controller 80. A portion of the instructions executed by the controller 80 implement an image evaluator 210 that processes captured image data of test patterns to generate positional correction data for roll and stitch errors. Other processes implemented by the controller 80 convert the positional correction data to stepper motor pulses or other control signals for manipulating the actuator 220 and the printheads 232, 234, 236, and 238.

The ejecting face of each printhead 232, 234, 236, and 238 includes a plurality of nozzles 243, 247, 245, 249, respectively, that may be arranged in rows that extend in the cross-process direction (X axis) across the ejecting face. The spacing between each nozzle in a row is limited by the number of ink jets that can be placed in a given area in the printhead. To enable the printing of drops onto a receiving substrate at distances that are closer in the cross-process direction than the distance between adjacent nozzles in a row, the nozzles in one row of a printhead are offset in the cross-process direction (along the X axis) from the nozzles in at least some of the other rows in the printhead. The offset between nozzles in adjacent rows enables the number of ink drops in a printed row to be increased by actuating the inkjets in a subsequent row to eject ink as the drops ejected by a previous row arrive. Of course, other arrangements of nozzles are possible. For example, instead of having offset rows of nozzles, the nozzles may be arranged in a grid in the ejecting face with linear rows and columns of nozzles. Each printhead in an assembly may be configured to emit ink drops of each color utilized in the imaging device. In such a configuration, each printhead may include one or more rows of nozzles for each color of ink used in the imaging device. In another embodiment, each printhead may be configured to utilize one color of ink so the jets of the printhead eject the same color of ink.

As discussed above, alignment of a printhead with respect to the receiving substrate and with respect to other printheads in the imaging device may present image quality issues. The possible degrees of movement for a printhead are now discussed with reference to FIG. 2. A printhead 204 may be rotated about each axis of an XYZ set of axes as shown in the figure. Rotation about the Y axis is called yaw, rotation about the X axis is called pitch, and rotation about the Z axis is called roll. Additionally, the printhead 204 may be translated along any one of the axes. In particular, stitch errors arise when the printhead shifts in the process (Y) direction or the cross-process (X) direction. These errors result in misalignment of drops from one printhead with the drops of another printhead. In the case of Y stitch errors the drops in the rows of one printhead are shifted up or down from the drops in the rows of another printhead. In the case of X stitch errors, the spacing between the last drop of one printhead is closer to or further away from the first drop of the next printhead than the spacing between adjacent drops in a printhead. These rotations and translations constitute the six degrees of freedom of movement for a printhead. Changes in printhead position may result from factors such as mechanical vibrations and other sources of disturbances on the machine components, which may alter print head positions and/or angles with respect to an image receiving surface.

Figure 3:
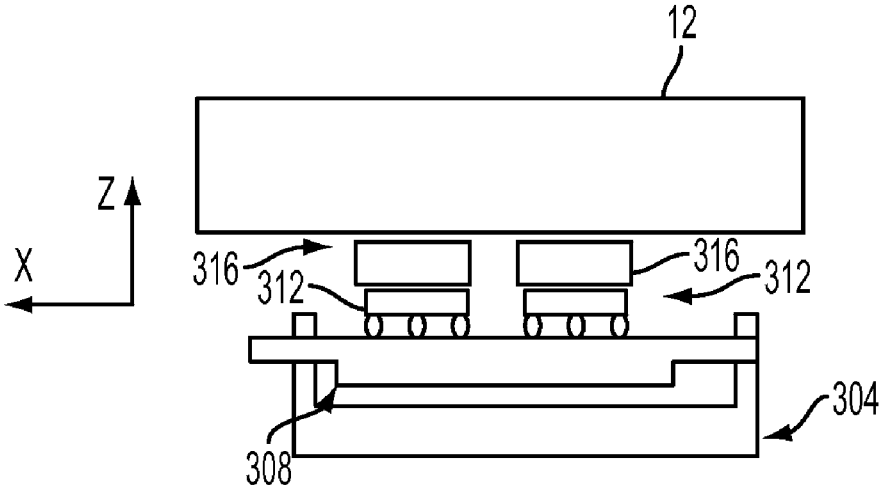
FIG. 3 is an illustration of two printheads mounted to two carrier plates that are rigidly connected to a translation carriage in a printer.

To facilitate independent alignment of printheads in a printhead assembly and enable more efficient replacement of printheads in the assembly, a carrier plate has been developed. The arrangement of the carrier plate and other components of a printer are now discussed with reference to FIG. 3. A retractable platform 304 is configured for moving towards and away from an image receiving member 12. A translation carriage 308 is mounted within the platform 304. The translation carriage 308 is coupled to an actuator that receives control signals from the controller 80 for selective reciprocating movement in a cross-process direction across the image receiving member 12. Rigidly mounted to the translation carriage 308 is a pair of carrier plates 312. To each carrier plate, a printhead 316 is rigidly mounted. This arrangement enables the printheads 316 to be replaced in the field with minimal impact on printhead alignment.

Figure 4:
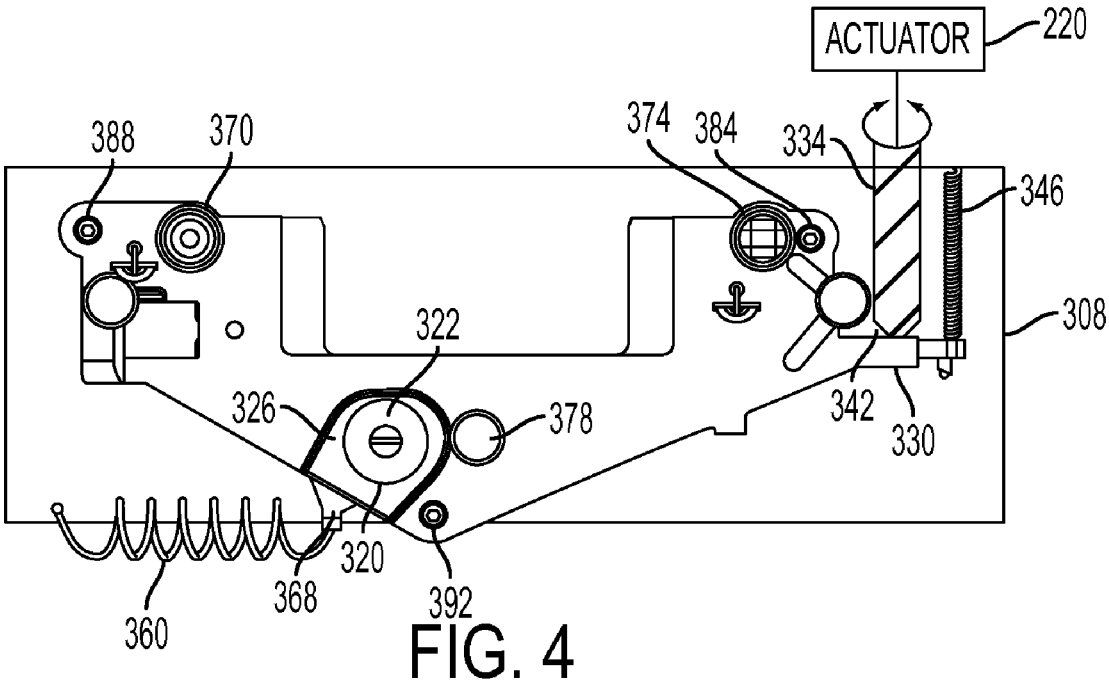
FIG. 4 is a front elevation view of a carrier plate mounted to a translation carriage.
Figure 5:
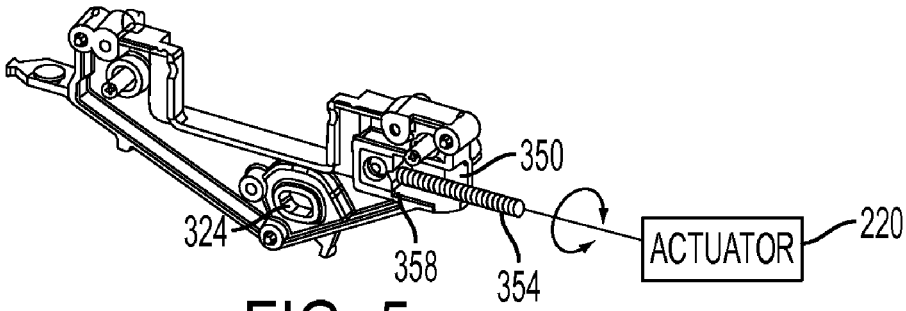
FIG. 5 is a rear elevation view of the carrier plate shown in FIG. 3.

The features of the carrier plate that enable independent alignment adjustment in some of the six degrees of freedom of movement are shown in FIG. 4. The carrier plate 312 is biased against three contact surfaces of the translation carriage 308. Two extension springs (not shown) provide a biasing force between plate 312 and carriage 308. The tips of screws 384, 388, and 392, which in one embodiment are spherical, rest against contact surfaces of carriage 308. This arrangement constrains the carrier plate 312 in the Z, pitch, and yaw directions relative to carriage 308. Additionally, the carrier plate is biased by spring 346 toward the screw 334 and by spring 360 toward the screw 354 (FIG. 5). In all, these bias springs and rests constitute the constraining arrangement of the carrier plate to the translation carriage. The threaded fastener 320 extends through elongated slot 324 (FIG. 5) to enable movement of the carrier plate about the fastener 320 as described in further detail below. A printhead 316 includes a plurality of rests that mate with recesses 370, 374, and 378 in the carrier plate 312. In one embodiment, recess 370 mates with a cone on the printhead, recess 374 mates with a V-shaped appendage on the printhead, and recess 378 mates with flat feature on the printhead. These recesses and spring loaded fasteners that secure the printhead 316 to the carrier plate 312 rigidly constrain the printhead to the carrier plate 312. The spring loaded force between the printhead and the carrier plate interacts with the recesses to enable the printhead to move in response to thermal changes in the printhead that may induce expansion and contraction. The recesses are made of sufficiently hard materials as they function as point supports that must withstand concentrated loads.

With further reference to FIG. 4, roll arm 330 extends from the carrier plate 312. A displaceable member 334, which may be a fine pitch lead screw, is interposed between the roll arm 330 and the transmission link components for actuator 220. As noted above, the actuator is coupled to the controller 80 to receive control signals. In response to one control signal, the actuator 220 rotates in a first direction to turn the displaceable member 334 having a terminating end 342 that contacts the roll arm 330 of the plate 312. Additionally, a biasing spring 346 is coupled between the translation carriage 308 and the roll arm 330 to urge the roll arm 330 against the member 334. In response to a second signal, the actuator 220 rotates the member 334 in an opposite direction and the spring 346 enables the roll arm to follow the member 334 as it is retracted by the actuator 220. The action of the actuator 220 and the member 334 rotate the carrier plate 312 about the fastener 320 to adjust the roll position of the carrier plate 312.

As shown in the rear view of the carrier plate 312 depicted in FIG. 5, a recess 350 is provided in the carrier plate 312. A lead screw 354 is positioned within the recess 350 to place the terminating end 358 of the screw 354 against the carrier plate 312. The other end of the screw 354 is coupled through transmission components to the actuator 220. In response to one control signal, the actuator 220 rotates in a first direction to turn the fine pitch lead screw 354 and translate the carrier plate 312 in the cross-process or X direction. Additionally, a biasing spring 360 is coupled between the translation carriage 308 and a return spring tab 368 extending from the carrier plate 312 (FIG. 4). The spring 360 urges the carrier plate 312 against the lead screw 354. In response to a second signal, the actuator 220 rotates the lead screw 354 in an opposite direction and the spring 360 enables the carrier plate 312 to follow the lead screw 354 as the screw is retracted by the actuator 220. The action of the actuator 220 and the lead screw 354 reciprocate the carrier plate 312 along the cross-process direction across the image receiving member 12.

Figure 2:
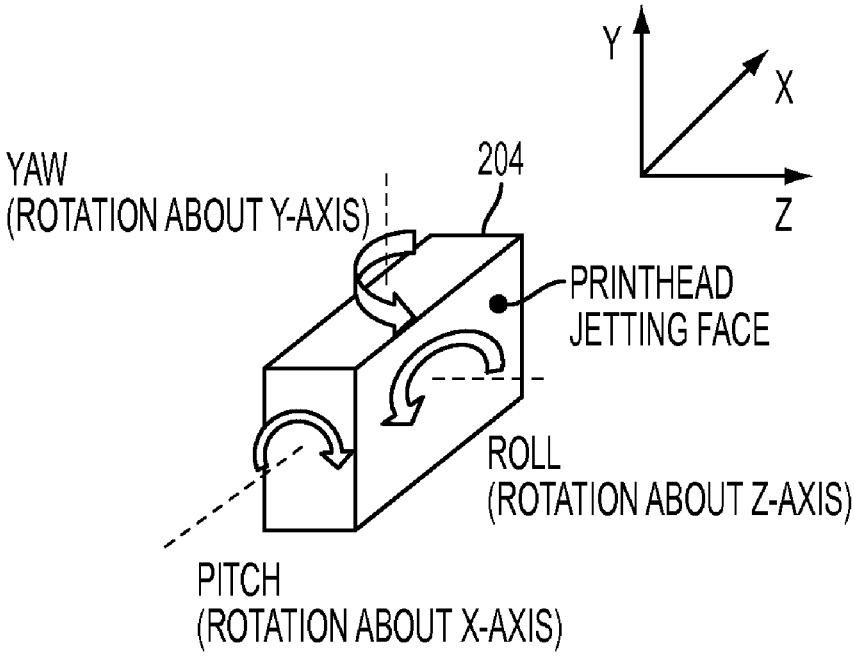
FIG. 2 is an illustration of the six degrees of freedom of movement for each printhead in the printhead assembly of FIG. 1.
Figure 6:
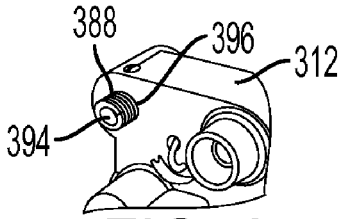
FIG. 6 is a detail view of one of the adjustable members located on the carrier plate that enable adjustment of the distance between the carrier plate and an imaging member as well as the pitch and yaw orientation of the carrier plate with respect to the imaging member.

Again with reference to FIG. 4, a plurality of initial adjustment members 384, 388, and 392 is shown. The adjustment members are positioned on the carrier plate 312 to enable adjustment of the carrier plate with respect to a distance between the carrier plate 312 and the imaging member 12 as well as the yaw orientation and pitch orientation of the carrier plate. The threaded member 388 is shown in FIG. 6 in greater detail. The other threaded members 384 and 392 are similarly configured. The threaded member 388 is shown with a hex-shaped recess 394 to accommodate an adjustment tool that may be used to rotate the threaded member in a clockwise or counterclockwise direction. Rotation in the counterclockwise direction retracts the threaded member from the thread mounting hole 396. Rotation in the opposite direction pushes the threaded member into the threaded hole. As shown in FIG. 5, each threaded member 384, 388, and 392 terminates into a rounded end. These rounded ends contact the translation carriage 308 at areas relatively free of obstructions to enable the threaded members to move in the X-Y plane (FIG. 2). Thus, rotation of the threaded members displaces a portion of the carrier plate 312 with reference to the translation carriage 308 and image receiving member 312. Each threaded member may be selectively moved using an adjustment tool to alter the distance between the face of the carrier plate and the image receiving member 12, the yaw orientation of the face of the carrier plate, and the pitch of the face of the carrier plate. A calibration system is used at a factory to set the yaw, pitch, and distance between the carrier plate and the image receiving member before the threaded members are locked in place with an adhesive compound.

Figure 7:
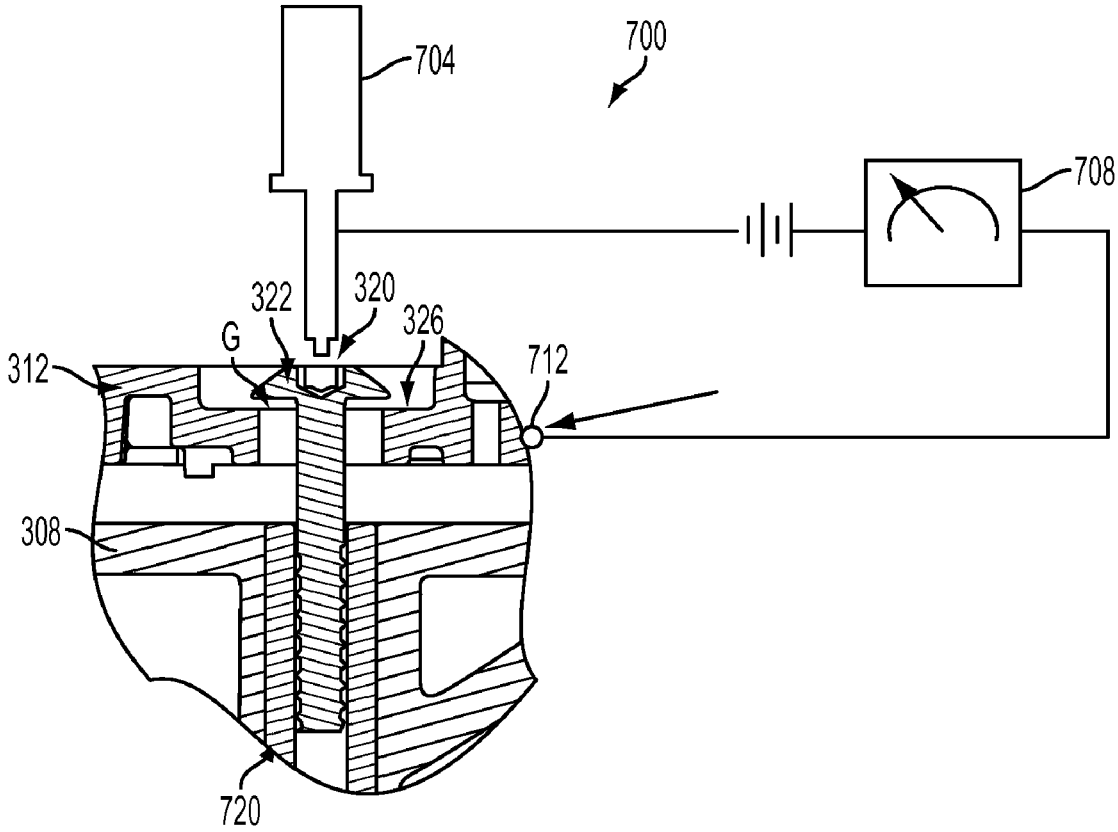
FIG. 7 is a detailed view of the ship restraint screw shown in FIG. 4 and the system used to position it appropriately with reference to the carrier plate.

The calibration procedure is now discussed with further reference to FIG. 7. Prior to the calibration procedure for setting the yaw, pitch, and distance between the carrier plate and image receiving member (Z position), the ship restraint screw 320 is inserted through slot 324 into screw mount 720 of carriage 308. Screw mount 720 is made of electrically insulating material for reasons made more apparent below. An automated gap adjustment system 700 includes a driver tool 704 and an ohmmeter 708. Lead 712 of the ohmmeter 708 is coupled to the carrier plate 312 and the other lead for the ohmmeter is coupled to the driver tool 704. Driver tool 704 is brought into contact with screw 320 to drive the screw until a relatively large gap G of about one millimeter is between the head 322 of screw 320 and the recessed area 326 of the carrier plate 312. This gap G enables the calibration procedure to set the yaw, pitch, and Z positions without hindrance. After the adjusting screws are locked into place with the adhesive, the driver tool 704 continues to drive the screw 320 until the ohmmeter senses a resistance that corresponds to predetermined level. The predetermined level indicates that the screw 320 contacts the carrier plate 312 without imparting a load on the plate, because any load could undermine the pitch, yaw, or Z position adjustments. In one embodiment, the predetermined resistance level is 10 ohms, although other carrier plate materials, screw materials, and related parameters may result in other resistance levels for other embodiments. The driver tool 704 stops driving the screw 320 in response to detection of the predetermined resistance level. The driver tool 704 then reverses the screw 320 by a predetermined fixed rotation angle to establish the gap G at a known small distance. In one embodiment, this known small distance is 0.127 mm. The controller of the system 700 verifies the resistance level sensed by the ohmmeter indicates no contact is being made between the screw 320 and the carrier plate 312. Upon confirmation of no contact being made, the system 700 is removed from the carrier plate and the calibration procedure is complete.

The factory calibrated carrier plate 312 has a high level of accuracy that enables any printhead manufactured to independent specifications to be installed on any carrier plate. Because the carrier plate is installed with such accuracy, printheads may be replaced in the field during the life of the printer without requiring any adjustments in the Z, pitch, or yaw directions. The actuated adjustments of the X stitch and roll angle positions that can be accomplished as described above enable a replacement printhead to integrate seamlessly into a multiple printhead array without requiring operator intervention.

In operation, the controller of a printing system is configured with programmed instructions for implementing the roll and stitch positional displacement correction data adjustment processes. During the life of the imaging system, the controller selects and operates the processes in accordance with a schedule or as they are activated manually. The processes generate test patterns, capture images of the test patterns, and evaluate the captured image data of the test patterns, to generate roll and stitch positional correction data. These data may be used to generate control signals for one or more actuators that are coupled to lead screws that contact the carrier plates as described above. The actuator turns the lead screws to adjust the roll and the position of the printhead in the cross-process direction. Adjustments in the Y axis position are adjusted by measuring an error in the Y position of ejected ink drops and compensating for these errors by either adjusting the timing of the firing signals to eject ink drops from ink jets as the image receiving member passes by the printhead.

It will be appreciated that various of the above-disclosed and other features, and functions, or alternatives thereof, may be desirably combined into many other different systems or applications. For example, cams may be used as displaceable members to contact the carrier plate and move the carrier plate in two directions with the actuator rotating in a single direction. Various presently unforeseen or unanticipated alternatives, modifications, variations, or improvements therein may be subsequently made by those skilled in the art, which are also intended to be encompassed by the following claims.

What is claimed is:

1. A system for independently aligning printhead position in an ink printing system comprising:

a printhead configured to eject ink onto an image receiving member;

a plate to which the printhead can be rigidly mounted and selectively removed, the plate including a plurality of recesses configured to mate with portions of the printhead to position the printhead with reference to the plate, and a roll arm extending from the plate;

an actuator coupled to a controller, the actuator turning in response to a first signal from the controller;

a movable member coupled to the actuator and contacting the roll arm, the movable member rotating the plate about an axis normal to and extending between the plate and the image receiving member in response to the first signal from the controller; and a translation carriage to which the plate is rigidly mounted and locked into position with reference to a distance between the plate and the image receiving member (Z position), a pitch position, and a yaw position, the translation carriage being coupled to another actuator for movement of the translation carriage, plate, and printhead in a cross-process direction across the image receiving member.

2. The system of claim 1 further comprising:

a biasing member coupled to the plate to urge the roll arm against the movable member.

3. The system of claim 2 wherein the actuator turns in an opposite direction in response to a second signal from the controller and the biasing member urges the roll arm to follow the movable member.

4. A printer that enables independent alignment of printhead position comprising:

an image receiving member;

two printheads configured to eject ink onto the image receiving member;

two plates, each plate having a plurality of recesses, which are configured to receive portions of one printhead to position the one printhead with reference to the plate and enable the one printhead to be rigidly mounted to the plate, and a roll arm extending from the plate;

an actuator coupled to a controller, the actuator turning in response to a first signal from the controller;

a movable member coupled to the actuator and contacting the roll arm, the movable member rotating the plate about an axis normal to and extending between the plate and the image receiving member in response to the first signal from the controller; and a translation carriage to which the two plates are rigidly mounted and each plate being locked into position with reference to a distance between the plate and the image receiving member (Z position), a pitch position, and a yaw position, the translation carriage being coupled to another actuator for movement of the translation carriage, plate, and printhead in a cross-process direction across the image receiving member and the plates being configured to enable the printheads to be removed from the plates without disturbing the Z position, pitch position, and yaw position of the plates.

5. The printer of claim 4 further comprising:

a biasing member coupled to the plate to urge the roll arm against the movable member to enable the roll arm to follow the movable member in response to the actuator turning in an opposite direction.

* * * * *